US007471914B2

(12) United States Patent
Jenak et al.

(10) Patent No.: US 7,471,914 B2
(45) Date of Patent: Dec. 30, 2008

(54) CLEANING UNIT FOR CLEANING A CONVEYOR BELT

(75) Inventors: Karl-Heinz Jenak, München (DE); Stefan Kreppold, Hallbergmoos (DE); Albert Eben, Oberpframmern (DE)

(73) Assignee: Oce Printing Systems GmbH, Poing (DE)

( * ) Notice: Subject to any disclaimer, the term of this patent is extended or adjusted under 35 U.S.C. 154(b) by 333 days.

(21) Appl. No.: 10/529,985

(22) PCT Filed: Oct. 10, 2003

(86) PCT No.: PCT/EP03/11263

§ 371 (c)(1),
(2), (4) Date: Oct. 3, 2005

(87) PCT Pub. No.: WO2004/036320

PCT Pub. Date: Apr. 29, 2004

(65) Prior Publication Data

US 2006/0104659 A1 May 18, 2006

(30) Foreign Application Priority Data

Oct. 10, 2002 (DE) ..... 102 47 366

(51) Int. Cl.
*G03G 15/16* (2006.01)

(52) U.S. Cl. ..... 399/101

(58) Field of Classification Search ..... 399/101, 399/350, 351, 360, 312
See application file for complete search history.

(56) References Cited

U.S. PATENT DOCUMENTS 4,334,766 A * 6/1982 Sugiyama et al. ..... 399/351
4,499,849 A * 2/1985 Tomita et al. ..... 399/164
4,500,196 A 2/1985 Shimura
4,730,205 A 3/1988 Ogiri et al.
4,978,999 A * 12/1990 Frankel et al. ..... 399/350
5,153,657 A * 10/1992 Yu et al. ..... 399/350
5,383,011 A 1/1995 Numagami et al.
5,450,184 A * 9/1995 Yanai et al. ..... 399/350
5,581,342 A 12/1996 Yamauchi
6,405,016 B1 6/2002 Fournier et al.
6,453,134 B1 * 9/2002 Ziegelmuller et al. ..... 399/101

FOREIGN PATENT DOCUMENTS

DE 198 31 786 2/1999
EP 0 546 751 6/1993
EP 546751 A2 * 6/1993
EP 0 691 594 1/1996
EP 0 511 848 8/1996

(Continued)

OTHER PUBLICATIONS

Patent Abstracts of Japan—03200191 A—Sep. 2, 1991.

(Continued)

*Primary Examiner*—Robert Beatty
(74) *Attorney, Agent, or Firm*—Schiff Hardin LLP

(57) ABSTRACT

A cleaning unit is provided for cleaning of a transport belt for transport of recording media in a electrographic printer or copying device. An abration element is positioned to avoid toner located on the transport belt. A toner capture reservoir captures abraded toner.

16 Claims, 4 Drawing Sheets

FOREIGN PATENT DOCUMENTS

| | | | | |
|---|---|---|---|---|
| EP | 0 807 870 | | | 11/1997 |
| JP | 61140975 | A | * | 6/1986 |
| JP | 63083766 | A | * | 4/1988 |
| JP | 04371978 | A | * | 12/1992 |
| JP | 05100609 | A | * | 4/1993 |
| JP | 05265362 | A | * | 10/1993 |
| WO | WO 99/64674 | | | 12/1999 |

OTHER PUBLICATIONS

Patent Abstracts of Japan 2003200191 A—Jul. 15, 2003.

* cited by examiner

CLEANING UNIT FOR CLEANING A CONVEYOR BELT

BACKGROUND

The present disclosed preferred embodiment concerns a cleaning unit and a method for cleaning a transport belt for transport of recording media in the transfer printing region of an electrographic printing or copying device, as well as an abrasion element and a capture reservoir for such a cleaning unit.

In electrographic printers or copiers, the transfer of a toner image from an intermediate carrier (for example a photoconductor drum or a photoconductor ribbon) onto a recording medium is designated as transfer printing. The section of the printing or copying device at which the intermediate carrier and the recording medium are brought into contact with one another is designated as a transfer printing region. In the transfer printing region, the intermediate carrier (meaning, for example, the generated surface of a photoconductor drum) and the recording medium move in the same direction with the same speed while the toner is transferred from the intermediate carrier onto the recording medium. A print image of high quality can only be achieved on the recording medium when a uniform contact between recording medium and intermediate carrier is produced in the transfer printing region and when the recording medium and the intermediate carrier actually move with exactly the same speed in the transfer printing region.

In order to ensure this, transport belts are proposed on which the recording media (for example electrostatically adhering) are transported through the transfer printing region. With such a transport belt, the transport speed of the recording medium in the transfer printing region can be predetermined exactly and without interference, and a uniform arrangement of the recording medium on the intermediate carrier can be achieved. Since the transport belt moves through the transfer printing region, it can easily be contaminated with toner. When, for example, individual paper sheets are used as recording media, toner can arrive on the intermediate regions between successive sheets and in the boundary regions outside of the paper dimension. In the event that the recording medium is printed on both sides, toner can moreover loosen from an already-printed side with which the recording medium lies on the transport belt and contaminate this. A transport belt contaminated with toner in turn contaminates subsequent recording media, which is not acceptable.

A cleaning unit is known from DE 198 31 786 A1 that has an abrasion element (arranged transverse to the running direction of the transport belt and lying on this) that is set to abrade toner located on a transport belt and that has a toner capture reservoir for capture of the abraded toner.

An abrasion element for a photoconductor drum is known from JP 03-200191. The abrasion element is comprised of a synthetic rubber that is admixed with 1 weight percent aluminum oxide as a polishing agent. A further abrasion element for a photoconductor drum is known from EP 0 691 594 A1. Rubber, plastic, metal and ceramic are cited therein as materials for the abrasion element. The material rubber is thereby preferred.

A cleaning unit with a mounting device for an abrasion element that is rotatable by 180° is known from EP 0 546 751 A2. Various edges of the abrasion element can thereby be used for cleaning. Toner capture reservoirs are disclosed in U.S. Pat. Nos. 4,730,205, 6,405,016 B1, 5,581,342 4,500,196 and 5,383,011.

SUMMARY

It is an object to specify a cleaning unit for cleaning of a transport belt with which the transport belt can be thoroughly cleaned of toner.

A cleaning unit is provided that has an abrasion element that is positioned to abrade toner located on the transport belt and a toner capture reservoir to capture the abraded toner.

DESCRIPTION OF THE PREFERRED EMBODIMENT

Figure 1:
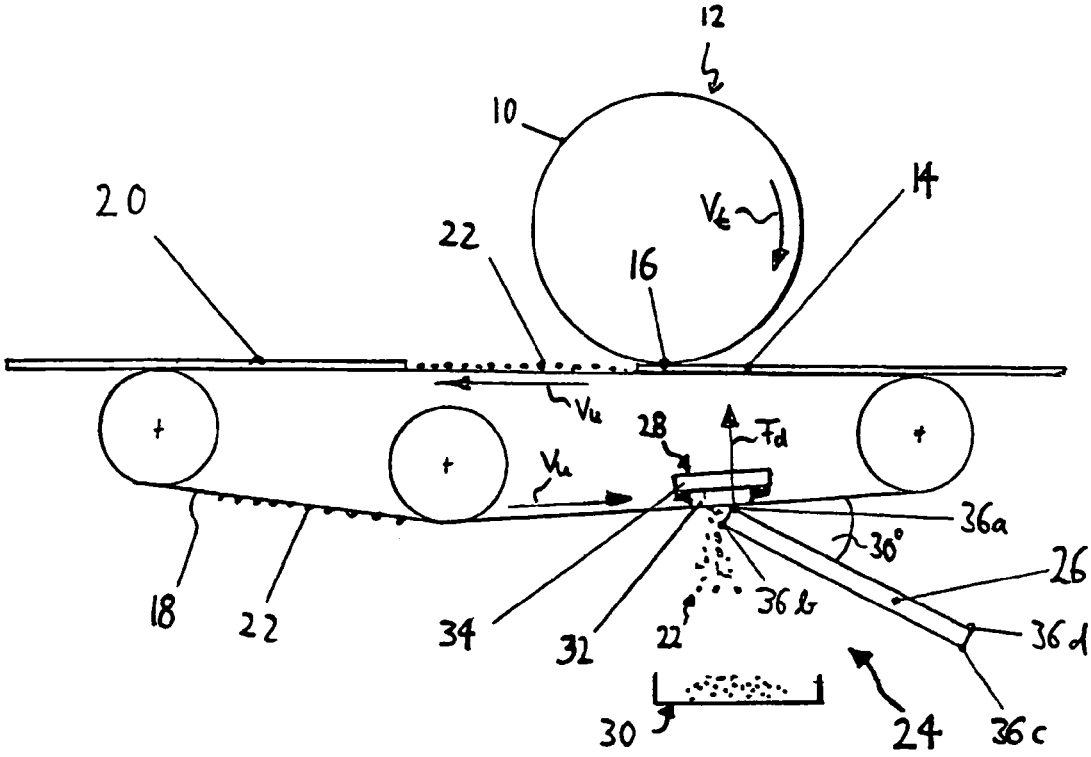
FIG. 1 is a schematic representation of a cleaning unit for cleaning of a transport belt for transport of recording media in the transfer printing region of an electrographic printer.

For the purposes of promoting an understanding of the principles of the invention, reference will now be made to the preferred embodiment illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

In tests, the use of very hard materials for the abrasion element has proven to be advantageous, both concerning the thoroughness of the cleaning and the wear of the transport belt and of the abrasion element itself. Abrasion elements made from ceramic, whose wear was by far less (due to their hardness) than, for example, that of a likewise tested abrasion element made of spring steel, have proven to be particularly advantageous. In a particularly advantageous embodiment, the abrasion element is made from an aluminum oxide ceramic that represents a very good compromise between high wear durability and advantageous production costs.

In the production of the ceramic it is advantageous to grind the initial materials to a grain size that is smaller than or equal to that of the toner particles. In the event that individual grains loosen from the ceramic abrasion element, the cavities created are small enough that no toner particles pass through them and therefore possibly remain on the transport belt in spite of the cleaning unit.

In an advantageous development of the present preferred embodiment, the abrasion element is designed as a cuboid-shaped abrasion bar. The cleaning unit also preferably has a mounting device in which the abrasion bar can be used in four different positions, whereby the four positions differ from one another by a rotation of the abrasion bar by respectively 180° around its longitudinal axis and/or its transverse axis. Via these four positions, all four longitudinal edges of the abrasion bar can be used in succession for abrasion of the toner, which quadruples the lifespan of the abrasion bar.

In order to conserve the longitudinal edges, the mounting preferably has recesses that prevent a contact of the longitudinal edges of the abrasion bar with the mounting. Longitudinal edges of the abrasion bar not yet used for abrasion thus remain sharp.

The mounting preferably has a receptacle in which the abrasion bar is inserted with a positive fit and a clamping plate with which the abrasion bar is clamped fast in the receptacle. The change of the position of the abrasion bar in the mounting device can thereby be implemented simply and quickly. In particular the alignment of the abrasion bar with regard to the transport belt thereby does not have to be readjusted, since the abrasion bar is placed in the mounting with a positive fit and therefore in an explicit position, and the position of the mounting does not vary upon changing the position of the abrasion bar.

A flexible support element for the transport belt is preferably provided on the side of the transport belt opposite the abrasion element. The transport belt can then be pressed against the flexible support element by the abrasion element, whereby a consistent contact results between transport belt and abrasion element.

The support element preferably comprises a felt lying on the transport belt. Such a felt offers a sufficient flexibility and at the same time serves to clean the side of the transport belt facing away from the abrasion element. In an advantageous development, the felt is arranged with a positive fit in a metal receptacle. It is thereby prevented that the felt is loosened or shifted by the transport belt.

As mentioned above, the cleaning unit of the preferred embodiment comprises a toner capture reservoir to capture the abraded toner. The captured toner can, for example, be transported with a screw transport from the toner capture reservoir into a waste toner reservoir present anyways in an electrographic printer or copier. The transport device necessary for placing the captured toner into the waste toner reservoir present anyway, is, however, relatively elaborate and costly. Therefore, in the present preferred development, such a transport is foregone and instead of this the capture reservoir is designed such that it can be removed from the printing or copying device. The capture reservoir thus simultaneously serves as an independent waste toner reservoir.

The toner capture reservoir can preferably be sealed in the printer or copying device. Upon removal of the capture reservoir from the printer or copying device, no toner can then be spilled.

In a preferred development, the toner capture reservoir is electrically conductive. The toner (normally electrostatically charged) can thereby be discharged in the toner capture reservoir and does not tend to accumulate at components located in the environment of the capture reservoir and charged opposite to the toner.

When the toner conveyance system is simultaneously used as a waste reservoir, it is important that it can be produced particularly cost-effectively. The toner capture reservoir is preferably comprised of plastic that can be cost-effectively processed. The toner capture reservoir is thereby preferably produced in a vacuum deep-draw method which enables a small material consumption and low production costs.

Guide grooves into which a cover to seal the toner capture reservoir can be inserted are preferably designed on the toner capture reservoir. The guide grooves are preferably formed by down-turned sections of the edge of the toner capture reservoir. The toner capture reservoir also preferably has an engagement section at which the toner capture reservoir can be engaged upon its removal from the printer or copying device and that is height-displaced relative to the guide grooves, such that it undercuts the inserted cover.

Longitudinal and/or transverse ribs that prevent a flow movement of the toner in the toner capture reservoir are preferably designed in the toner capture reservoir.

In a preferred development, the cleaning unit comprises a microswitch that scans whether the toner capture reservoir is correctly arranged in the printer or copier.

The transfer printing of a toner image from the generated surface 10 of a photoconductor drum 12 onto a sheet of paper 14 is schematically shown in FIG. 1. The transfer of the toner from the photoconductor drum 12 onto the paper sheet 14 occurs in the transfer printing region 16, in which the generated surface 10 of the photoconductor drum 12 and the sheet 14 contact one another. The toner located on the generated surface 10 of the photoconductor drum 12 is electrostatically charged and is transferred onto the sheet 14 in a known manner with the aid of electrostatic field forces.

The sheet 14 electrostatically adheres to the transport belt 18 that revolves counterclockwise with a revolution speed $V_U$ in the representation of FIG. 1, as is indicated by corresponding speed arrows. The photoconductor drum 12 rotates clockwise in the representation of FIG. 1, whereby the generated surface 10 moves with a tangential speed $V_U$ of the transport belt 18. The exact coincidence of $V_T$ and $V_U$ is a precondition of the toner image being transfer printed without distortion and without smearing.

In addition to the sheet 14 located in the transfer printing region 16 in FIG. 1, an already-printed sheet 20 is shown. The transport belt 18 is contaminated with toner particles 22 (schematically shown) between these two successive sheets. The toner particles 22 may, for example, have been transferred from the photoconductor drum 12 onto the transport belt 18 when this was not completely cleaned of residual toner.

Furthermore, a cleaning unit 24 for cleaning of the transport ribbon 18 is shown in FIG. 1. The cleaning unit 24 comprises an abrasion bar 26 that is arranged transverse to the running direction of the transport belt 18, a support element 28, and a toner capture reservoir 30. The support element 28 is likewise arranged transverse to the running direction of the transport belt 18 and has a flexible felt 32 that is arranged with a positive fit in a metal receptacle 34.

With the transport belt 18, the abrasion bar 26 encloses an angle of 30° and, with its first longitudinal edge 36*a*, presses the transport belt 18 against the felt 32 of the support element 28 with a pressure force $F_d$ represented in FIG. 1 by a force arrow. The pressure force $F_d$ is generated by a spring (not shown in FIG. 1) with which the abrasion bar 26 is pressed with its first longitudinal edge 36*a* against the transport belt 18 such that it acts in an impinging manner counter to the belt running direction. When the transport belt passes the cleaning unit 24, toner 22 adhering on the transport belt remains hanging on the longitudinal edge 36*a* of the abrasion bar 26 and, due to gravity, falls into the toner capture reservoir 30.

Figure 2:
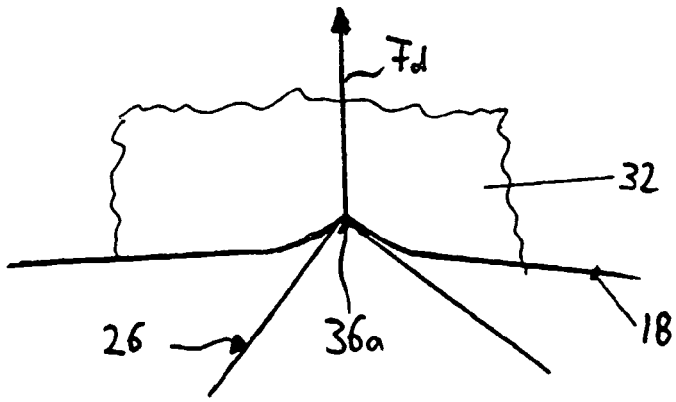
FIG. 2 a schematic representation of the transport belt of FIG. 1 that is pressed by an abrasion element against the felt of a support element.

The abrasion bar 26, the transport belt 18 and the felt 32 of FIG. 1 are shown in an enlarged view in FIG. 2. As is to be seen therein, due to the pressure force $F_d$ the transport belt 18 travels closely around the longitudinal edge 36*a* such that no toner particles 22 pass this.

In the shown exemplary embodiment, the abrasion bar 26 is comprised of an aluminum oxide ceramic and the transport belt 18 is comprised of polyvinylidenfluoride (PVDF). The combination of the very hard ceramic with the soft transport belt enables a very thorough cleaning with very low wear, both of the transport belt 18 and of the abrasion bar 26. The ceramic allows a very smooth, even and precise production of the abrasion bar, which contributes to the thoroughness of the cleaning and to the lifespan of the transport belt 18. The friction forces occurring between PVDF belt 18 and ceramic bar 26 are so slight that the belt speed is barely affected by the abrasion bar.

The surface quality of the ceramic abrasion bar 26 is tuned to the grain size of the toner. In particular, in its production the initial materials of the ceramic are milled to a grain size that is smaller or equal to that of the toner particles. When individual grains loosen from the ceramic, the cavities thereby created in the abrasion bar are so small that no toner particles 22 pass through and thus can remain on the transport belt 18.

Figure 3:
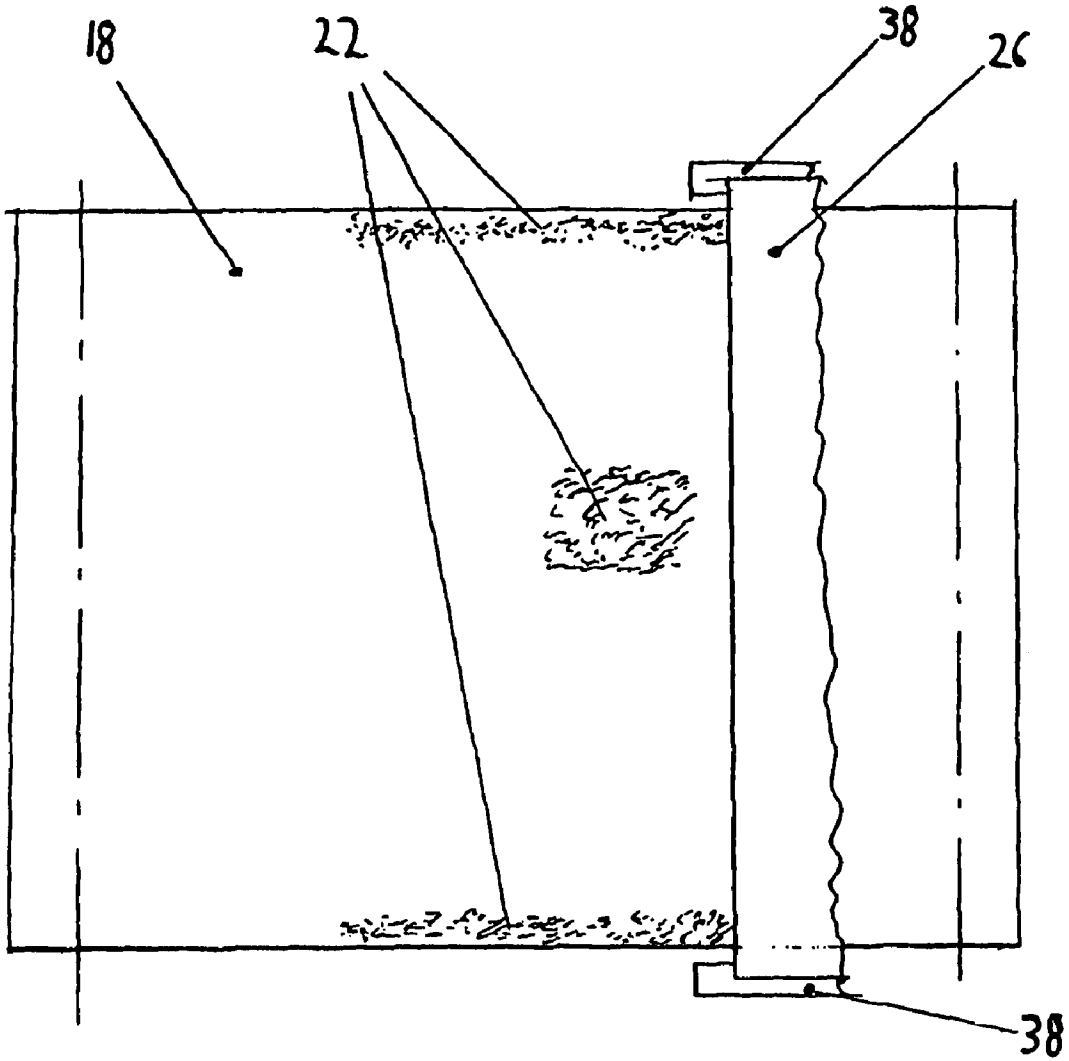
FIG. 3 a bottom view of the transport belt of FIG. 1 with abrasion bar lying thereon.

A bottom view of the transport belt 18 and a part of the abrasion bar 26 are shown in FIG. 3. The abrasion bar 26 is arranged with positive fit in a mounting 38 and extends transverse to the running direction of the transport belt 18 over its entire width. For reasons of clarity, the mounting 38 was left out in the schematic representation of FIG. 1. The mounting 38 is set once transverse to the transport belt 18, such that a uniform pressure force $F_d$ results over the entire width of the transport belt 18. Since the abrasion bar 26 is arranged with a positive fit in the mounting 38, neither the abrasion bar 26 nor the mounting 38 have to be readjusted when the abrasion bar 26 is exchanged or, as is described in detail below, when the abrasion bar 26 is rotated around one of its axes of symmetry.

As is furthermore shown in FIG. 3, the toner 22 can adhere both to the edges of the transport belt and in a middle region of the same. It is therefore necessary to ensure a uniform pressure force $F_d$ over the entire width of the transport belt 18, as is the case in the shown exemplary embodiment.

Figure 5:
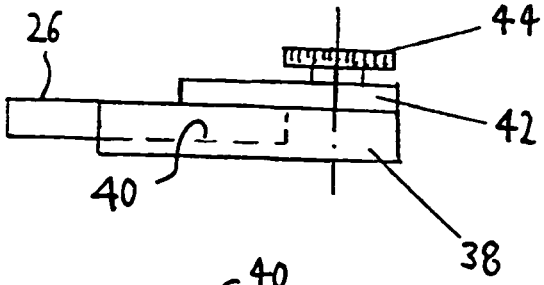
FIG. 5 is a side view of the abrasion bar of FIG. 1 through 4 in its mounting.
Figure 4:
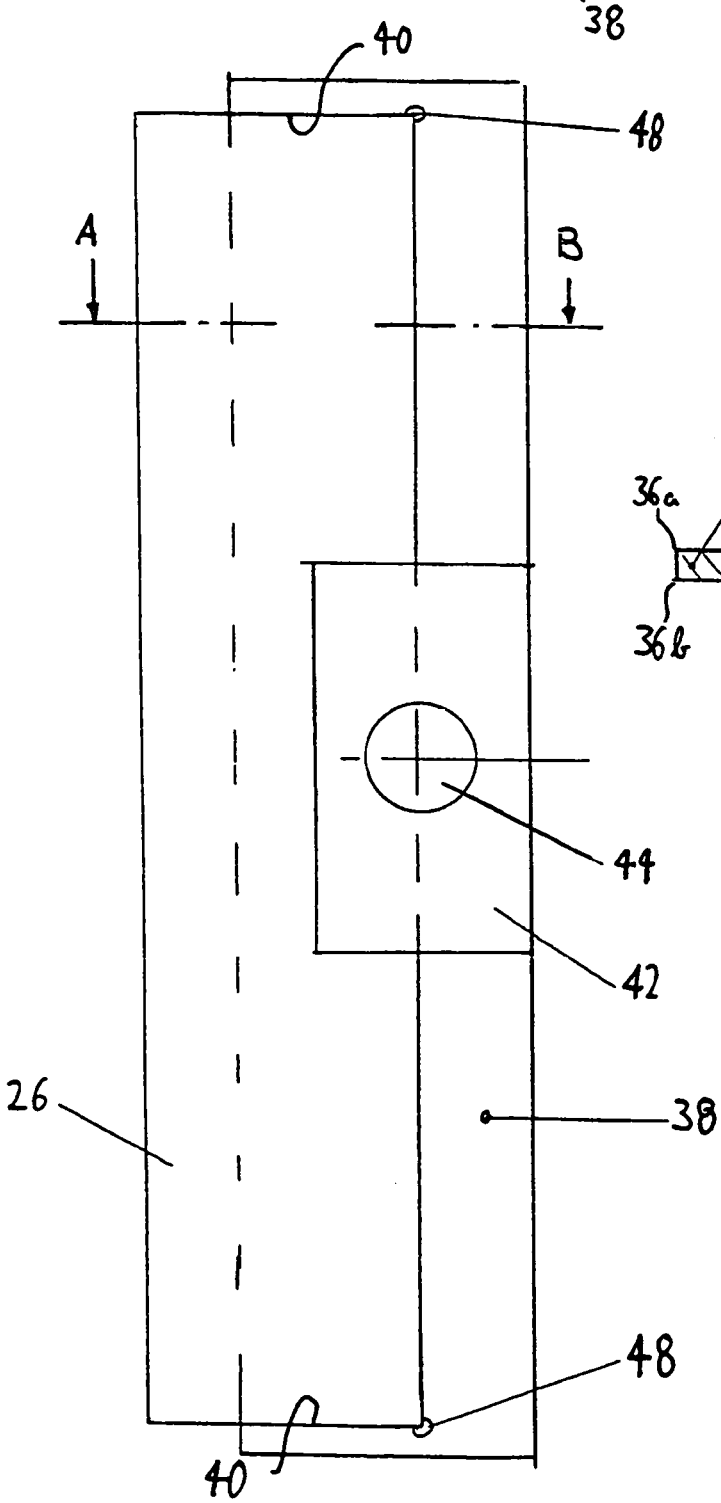
FIG. 4 is a plan view of the abrasion bar of FIG. 1 through 3 in its mounting.
Figure 6:
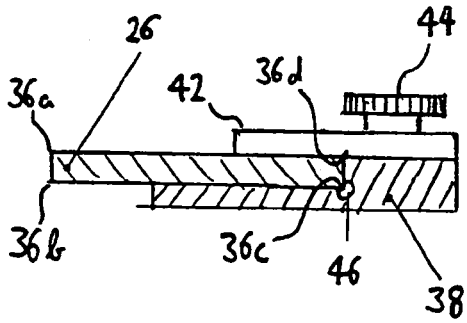
FIG. 6 is a section along the line A-B of FIG. 4.

The mounting device 38 and the abrasion bar 26 are shown in FIGS. 4, 5 and 6. FIG. 4 is a plan view and FIG. 5 is a side view of the mounting device 38, which has a receptacle 40 in which the abrasion bar 26 is arranged with positive fit. As is likewise shown in FIGS. 4 and 5, the abrasion bar 26 is clamped fast in the recess 40 with the aid of a clamping plate 42 that is attached to the mounting 38 in a detachable manner with the aid of a knurled screw 44.

As is to be seen in FIGS. 4 and 5, the abrasion bar 26 is cuboid-shaped. The abrasion bar can thereby be uniformly used in four different positions in the recess 40 of the mounting 38, whereby the positions differ from one another by a rotation of the abrasion bar of respectively 180° around its longitudinal axis and/or is transverse axis, thus its axes of symmetry. In each of these four positions, another of the four longitudinal edges 36*a* through 36*d* of the abrasion bar 26 comes to rest on the transport belt 18. By changing these positions, the lifespan of the abrasion bar 26 is quadrupled.

A cross-section along the line A-B of FIG. 4 is shown in FIG. 6. A recess 46 in the receptacle 40 of the mounting 38 is to be seen therein that extends over the entire length of the receptacle 40 and prevents a contact of the longitudinal edges of the abrasion bar 26 with the mounting 38. The longitudinal edges 36*a* through 36*d* of the abrasion bar 26 are thereby prevented from damage. Similar recesses 48 for the transverse edges of the abrasion bar 26 are likewise shown in FIG. 4.

Figure 7:
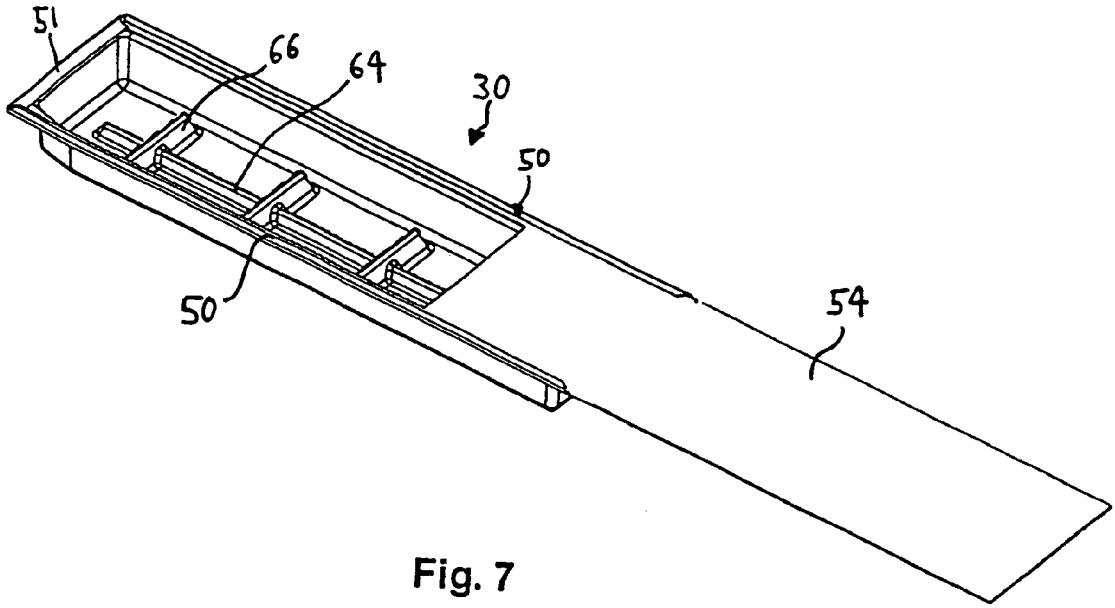
FIG. 7 a perspective view of a toner capture reservoir with partially inserted cover.
Figure 8:
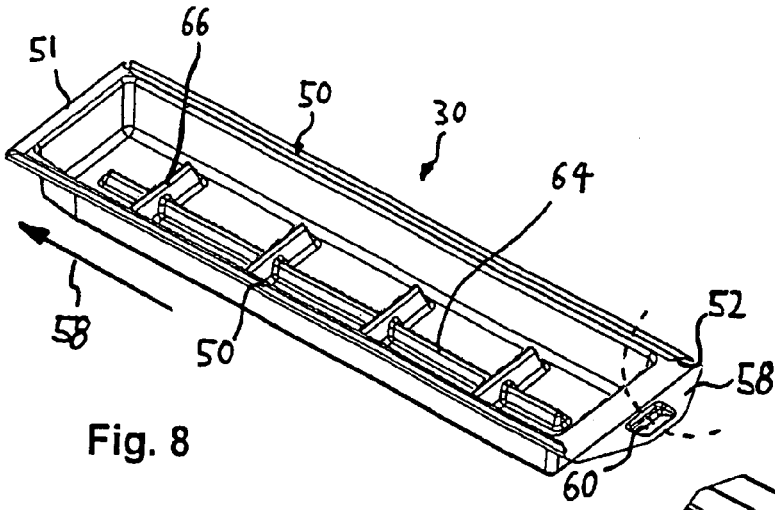
FIG. 8 a perspective view of the toner capture reservoir of FIG. 7 without cover.

The toner capture reservoir 30 shown only schematically in FIG. 1 is shown in detail in FIGS. 7 and 8. The toner capture reservoir 30 simultaneously serves as a waste reservoir and is therefore designed as a cost-effective disposable part that can be simply removed from the printer or copying device and replaced by a new one. The toner capture reservoir 30 is produced from plastic and in a vacuum deep-draw method. Its longitudinal edges 50 and its rear transverse edge 51 are recurved inwards, such that guide grooves 52 result in which a pasteboard 52 (FIG. 7) can be inserted from the front while the toner capture reservoir 30 is still located in the printer or copier such that it no toner spills upon its removal.

Figure 9:
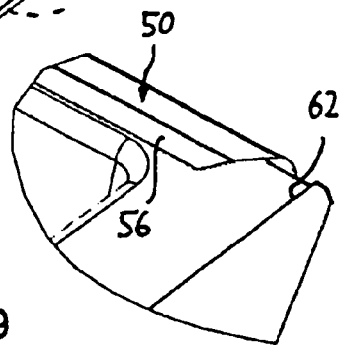
FIG. 9 is an enlarged section of FIG. 8.

FIG. 9 shows the section characterized by a dashed circular arc in FIG. 8 in enlarged representation. In FIG. 9, the guide grooves 2 are easily recognizable. The recurved edge 50 of the toner capture reservoir 30 has a section 56 drawn slanted downwards. This section exerts a light pressure on the inserted cover 54 (FIG. 7), such that this seals the toner capture reservoir tight. As is in particular to be seen in FIG. 9, the down-turned longitudinal edge 50 is canted on its end facing forwards in order to ease the insertion of the cover 54.

The toner capture reservoir 30 has an engagement section with recessed grip 60 formed therein on its forward transverse side (narrow side situated to the right in the representation of FIG. 7). A Z-shaped step 62 that undercuts the inserted cover 54 and provides for secure sealing of the toner capture reservoir 30 is formed in the engagement section 58. A longitudinal rib 64 and four transverse ribs 66 that prevent a flow movement of the toner in the toner capture reservoir 30 are formed inside the toner capture reservoir 30.

For accommodation of the toner capture reservoir 30 in the printer or copying device, rope profiles (not shown) are arranged into which the toner capture reservoir 30 is inserted at its rear end with its longitudinal edges 50 and is introduced into the device (not shown) in the direction characterized with arrow 58 in FIG. 8. A microswitch (not shown) that scans the rear transverse edge 51 or a rear section of the longitudinal edge 50 is also located in the device. In the event that the toner capture reservoir 30 is not or is incorrectly introduced into the device or is not inserted far enough into the device, this is detected by the microswitch and a print or copy operation is prevented.

Although a preferred exemplary embodiment is shown and specified in detail in the drawings and the preceding specification, this should be viewed as purely exemplary and not as limiting the invention. It is noted in this regard that only the preferred exemplary embodiment is shown and specified, and all variations and modifications should be protected that presently or in the future lie within the scope of protection of the invention.

We claim as our invention:

1. A cleaning unit for cleaning of a transport belt for transport of recording media in a transfer printing region of an electrographic printer or copying device, comprising:

a ceramic abrasion element comprising a rigid elongated bar positioned transverse to a running direction of the transport belt to abrade toner located on the transport belt with either of at least two opposite corner edges by rotating the bar 180° for the abrading, materials of the ceramic element having a grain size smaller than or equal to that of the toner particles;

a flexible support element for the transport belt provided on a side of the transport belt opposite the abrasion element;

a toner capture reservoir to capture the abraded toner;

the capture reservoir being removable from the printer or copying device; and an opening of the toner capture reservoir through which the abraded toner falls into the toner capture reservoir being selectively sealable in the printer or copying device.

2. A cleaning unit according to claim 1 in which the abrasion element is designed as a cuboid-shaped abrasion bar.

3. A cleaning unit according to claim 2 with a mounting device in which the abrasion bar is set in four different positions, the four positions differing from one another by a rotation of the abrasion bar by 180° around at least one of its longitudinal axis and its transverse axis.

4. A cleaning unit according to claim 3 in which the mounting device has recesses that prevent a contact of the longitudinal edges of the abrasion bar with the mounting device.

5. A cleaning unit according to claim 3 in which the mounting device comprises a receptacle in which the abrasion bar is set with a positive fit and a clamping plate with which the abrasion bar is clamped fast in the receptacle.

6. A cleaning unit according to claim 1 in which the support element comprises a felt lying on the transport belt.

7. A cleaning unit according to claim 6 in which the felt is arranged with a positive fit in a metal receptacle.

8. A cleaning unit according to claim 1 in which the toner capture reservoir is electrically conductive.

9. A cleaning unit according to claim 1 in which the toner capture reservoir comprises plastic.

10. A cleaning unit according to claim 9 in which the toner capture reservoir is produced in a vacuum deep-draw method.

11. A cleaning unit according to claim 1 in which guide grooves in which a slidable cover is insertable to seal the toner capture reservoir are formed on the toner capture reservoir.

12. A cleaning unit according to claim 11 in which the guide grooves are formed by down-turned sections of an edge of the toner capture reservoir.

13. A cleaning unit according to claim 11 with an engagement section at which the toner capture reservoir is gripped upon its removal from the printer or copying device and that is height-displaced relative to the guide grooves such that it undercuts the insertable cover.

14. A cleaning unit according to claim 1 in which at least one element selected from the group consisting of longitudinal and transverse ribs are formed in the toner capture reservoir.

15. A cleaning unit according to claim 1 with a microswitch that scans whether the toner capture reservoir is correctly arranged in the printer or copier.

16. An abrasion element according to claim 1 that is designed as a cuboid-shaped bar and that has four longitudinal edges designed to abrade toner.

* * * * *